US007364678B2

(12) United States Patent
Smit et al.

(10) Patent No.: US 7,364,678 B2
(45) Date of Patent: Apr. 29, 2008

(54) PROCESS FOR MAKING AND PROCESS FOR CONVERTING POLYOLEFIN FIBRES

(75) Inventors: Leo Smit, Oirsbeek (NL); Joseph Arnold Paul Maria Simmelink, Sittard (NL); Leonard Josef Arnold Nielaba, Eygelshoven (NL)

(73) Assignee: DSM IP Assets B.V., Heerlen (NL)

( * ) Notice: Subject to any disclaimer, the term of this patent is extended or adjusted under 35 U.S.C. 154(b) by 457 days.

(21) Appl. No.: 10/537,899

(22) PCT Filed: Dec. 9, 2003

(86) PCT No.: PCT/NL03/00872

§ 371 (c)(1),
(2), (4) Date: Jul. 19, 2005

(87) PCT Pub. No.: WO2004/053212

PCT Pub. Date: Jun. 24, 2004

(65) Prior Publication Data

US 2006/0012069 A1 Jan. 19, 2006

(30) Foreign Application Priority Data

Dec. 10, 2002 (EP) ..... 02080143

(51) Int. Cl.
*D02G 1/20* (2006.01)

(52) U.S. Cl. ..... 264/103; 264/129; 264/165; 264/205; 264/211.14; 428/357; 428/375; 428/394

(58) Field of Classification Search ..... 264/103, 264/165, 211.16, 130, 129, 205, 210.8, 211.14, 264/178 R; 428/357, 375, 364, 394
See application file for complete search history.

(56) References Cited

U.S. PATENT DOCUMENTS

| | | | | |
|---|---|---|---|---|
| 3,630,205 | A | 12/1971 | Listner et al. | |
| 5,466,406 | A | 11/1995 | Liu | |
| 6,174,934 | B1 * | 1/2001 | Sun et al. | 523/113 |
| 6,324,456 | B2 * | 11/2001 | Bosse | 701/54 |
| 7,005,143 | B2 * | 2/2006 | Abuelyaman et al. | 424/487 |
| 2006/0012069 | A1 * | 1/2006 | Smit et al. | 264/165 |

FOREIGN PATENT DOCUMENTS

| | | |
|---|---|---|
| EP | 0 205 960 | 12/1986 |
| EP | 0 526 759 | 2/1993 |
| EP | 176187 A1 * | 1/2007 |
| GB | 1 588 031 | 4/1981 |

* cited by examiner

*Primary Examiner*—N. Edwards
(74) *Attorney, Agent, or Firm*—Nixon & Vanderhye P.C.

(57) ABSTRACT

The invention relates to a process for making a multi-filament polyethylene yarn via a gel-spinning process, Wherein a spin finish is applied at least once in an amount of 0.1-10 mass % based on the filament, to a filament that contains less than 50 mass % of solvent; the spin finish comprising at least 95 mass % of at least one volatile compound having a boiling point at 0.1 MPa pressure of from 30 to 250° C.; and the spin finish is subsequently removed by exposing the filament to a temperature of below the melting temperature of the filament. With this process a yarn is made that has a very low amount of residues on the surface of the fibres, without the need for a washing or extraction step, showing good mechanical properties, and very suited for e.g. biomedical applications. The invention further relates to a process for converting polyolefin fibres into a semi-finished or end-use product. The invention also concerns a polyethylene yarn and a semi-finished or end-use product obtainable by said processes, as well as to the use of thereof in biomedical applications.

19 Claims, No Drawings

PROCESS FOR MAKING AND PROCESS FOR CONVERTING POLYOLEFIN FIBRES

This application is the US national phase of international application PCT/NL2003/000872 filed 9 Dec. 2003 which designated the U.S. and claims benefit of EP 02080143.7, dated 10 Dec. 2002, the entire content of which is hereby incorporated by reference.

The invention relates to a process for making a polyolefin multi-filament yarn having a low level of spin finish residues comprising the steps of spinning at least one filament; drawing the filament in at least one drawing step; applying a spin finish to a filament; and removing the spin finish again.

The invention further relates to a process for converting polyolefin yarn into a semi-finished or end-use product. The invention also concerns a polyethylene yarn and a semi-finished or end-use product obtainable by said processes, as well as to the use thereof in biomedical applications. The invention further relates to a biomedical product comprising said yarn or product.

Such a process is known from U.S. Pat. No. 5,466,406 A. This patent publication describes a process wherein a spin finish is applied to one or more filaments, like melt-spun polypropylene filaments as in the examples, which spin finish consists essentially of glycerol and a volatile solvent, especially iso-propanol, and optionally small amounts of other functional ingredients. After application of the spin finish, the solvent is rapidly evaporated, e.g. flashed by heating, thereby leaving the glycerol and optionally other ingredients on the yarn. The yarn thus obtained is indicated to be useful in making surgical devices, because the glycerol-based spin finish is non-toxic and can be removed if desired from the yarn by washing with water.

It is generally accepted in the synthetic fibres manufacturing industry, that a spin finish, also referred to as a fibre finish or finishing oil, is a prerequisite for enabling high-speed fibre production and subsequent further processing. Without applying a spin finish, virtually all operations performed on fibres after being spun from the melt or a solution would be hampered by for example snarling, or even premature breaking of filaments (see for example Encyclopedia of Polymer Science and Engineering, Vol. 6, p. 828 if, John Wiley & Sons, Inc. New York (1986), ISBN 0-471-80050-3; Processing of Polyester Fibres, p. 45 ff, Elsevier, Amsterdam (1979), ISBN 0-444-99870-5; or Ullmann's Encyclopedia of Industrial Chemistry, Fibers, 3. General Production Technology, Wiley-VCH Verlag GmbH, Weinheim (2002); available via http://www.mrw.interscience.wiley.com/ueic/ull_subframe.html).

A spin finish is generally applied during the spinning process before windup of yarn into packages, in order to reduce friction of the filaments against guides, to improve inter-filament cohesion, and to reduce electrostatic charge development. More or another finish may be applied later to modify yarn behaviour during subsequent converting steps, e.g. handling and processing into semi-finished or end products.

A spin finish according to the art typically is a composition comprising a mixture of components, like a lubricating agent; an emulsifier; an antistatic agent: a bactericide or fungicide; and an antioxidant, dissolved or dispersed in a solvent. Compounds used in spin finishes include hydrocarbon oils, long-chain aliphatic esters, poly(oxy alkylene) condensates attached to aliphatic chains, long-chain quaternary ammonium salts, long-chain alkyl phosphates, and silicones. Generally, a spin finish composition contains at least 25 mass % of components. Spin finishes can be applied by passing through a bath, by using a wick, a rotating wheel or nip roll, or by spraying.

For yarns or fibres to be suitable for use in medical applications, like surgical devices or implants, the presence of residues originating from e.g. a spin finish is generally not allowed, or requires specific approvals for every component. One approach to making a fibre that is substantially free from residues is to extensively wash the fibre at some point in order to remove any applied spin finish component. Such a removal step can comprise extraction of the fibre with an organic solvent, for example a chlorofluorocarbon; extraction with a supercritical gas like carbon dioxide; washing with aqueous solutions containing surfactants and the like, or a combination thereof. Disadvantages of this approach are, that it is generally difficult or even impossible to completely remove typical spin finish components as mentioned above, that solvents like chlorofluorocarbons are at least environmentally suspect, and that it greatly adds costs to the manufacturing process. In addition, such washing or extraction processes can deteriorate mechanical properties, like tensile strength of the fibre.

In the process known from U.S. Pat. No. 5,466,406 A, the main constituent of the spin finish is glycerol, which is stated to be non-toxic, and which can be washed off with water afterwards. A disadvantage of this known process, however, is that a washing step is still needed to make a fibre that is substantially free from spin finish residues, and that there remains a certain risk of residues being present.

It is therefore an object of the present invention to provide a process for making a polyolefin yarn that has a low level or even no measurable amount of spin finish residues on its surface, and which process requires no washing or extraction step.

This object is achieved according to the invention with a process for making a polyethylene multi-filament yarn comprising the steps of a) spinning at least one filament from a solution of ultra high molecular weight polyethylene in a solvent;
b) cooling the filament obtained to form a gel filament;
c) removing at least partly the solvent from the gel filament;
d) drawing the filament in at least one drawing step before, during or after removing solvent;
e) applying a spin finish at least once in an amount of 0.1-10 mass % based on the filament, to a filament that contains less than 50 mass % of the solvent; the spin finish comprising at least 95 mass % of at least one volatile compound having a boiling point at 0.1 MPa pressure of from 30 to 250° C.; and
f) removing the spin finish by subsequently exposing the filament to a temperature of below the melting temperature of the filament, such that carbon and oxygen atomic concentrations at the surface of the filament of at least 95% C and at most 5% O, as measured by XPS analysis, result.

With the process of the present invention polyethylene yarn is made that has a very low or no measurable amount of residues on the surface of the filaments, without the need for a washing or extraction step. Such polyethylene yarns that are substantially free from spin finish residues have high tensile strength and are very suited for e.g. biomedical applications, but also for other applications where finish residues could present problems, for example in composites where adhesion between fibres and matrix material may be affected. The polyethylene yarns made by the process do not show excess slip during further processing, and allow a smoother braiding operation than fibres with conventional spin finish residues. A further advantage is that the dyeing behaviour of the yarn obtained with the process is not hampered by finish residues. A further important advantage is that the spin finish can be applied at that stage in the process for making polyolefin yarn where it is actually needed, and can be subsequently removed if advantageous for a next stage. In addition, the spin finish can be applied at more than one stage if desirable. An additional advantage of applying spin finish according to the invention also before a final drawing step is that filaments are more effectively cooled after hot drawing, probably because of evaporating finish; with as another advantage that fiber packages made in a subsequent winding step show less variation in temperature with increasing package thickness and less variation in tensile properties of the wound fiber. A further advantage is that the processing equipment used shows less fouling. Also advantageous is that the components of the spin finish present no environmental threat, are non-toxic, and of low cost.

The process for making a polyethylene yarn according to the invention comprises the steps of a) spinning at least one filament from a solution of ultra high molecular weight polyethylene (UHMwPE) in a solvent; b) cooling the filament obtained to form a gel filament c) removing at least partly the solvent from the gel filament; and d) drawing the filament in at least one drawing step before, during or after removing solvent. Such a spinning process is generally referred to as a gel spinning process. Gel spinning of UHMwPE has been described in various publications, including EP 0205960 A, EP 0213208 A1, U.S. Pat. No. 4,413,110, WO 01/73173 A1, and Advanced Fiber Spinning Technology, Ed. T. Nakajima, Woodhead Publ. Ltd (1994), ISBN 1-855-73182-7, and references cited therein.

Preferably, the UHMwPE applied in the process according to the invention is a linear polyethylene, i.e. a polyethylene with less than one side chain or branch per 100 carbon atoms, and preferably less than one side chain per 300 carbon atoms, a branch generally containing at least 10 carbon atoms. The polyethylene may further contain up to 5 mol % of or more alkenes that can be copolymerized with it, such as propylene, butene, pentene, 4-methylpentene or octene. The polyethylene may further contain small amounts of additives that are customary for such fibres, such as anti-oxidants, thermal stabilizers, colorants, etc.

Preferably, the polyethylene, has an intrinsic viscosity (IV) of more than 5 dl/g. Fibres made from such polyethylene have very good mechanical properties, such as a high tensile strength, modulus, energy absorption at break. More preferably, a polyethylene with an IV of more than 10 dl/g is chosen. Such gel-spun UHMwPE yarn offers a combination of high strength, low relative density, good hydrolysis resistance, and excellent wear properties, making it suited for use in various biomedical applications, including implants. The IV is determined according to method PTC-179 (Hercules Inc. Rev. Apr. 29, 1982) at 135° C. in decalin, the dissolution time being 16 hours, with DBPC as the anti-oxidant in an amount of 2 g/l solution, and the viscosity at different concentrations is extrapolated to zero concentration.

In the process according to the invention any of the known solvents for gel spinning of UHMwPE can be used, for example paraffin wax or oil, or decalin. Cooling of the filament into a gel filament may be performed with a gas flow, or by quenching the filament in a liquid cooling bath. Solvent removal can be performed by known methods, for example by evaporating a relatively volatile solvent, or by using an extraction liquid.

The process for making a polyethylene yarn according to the invention further comprises drawing the filament in at least one drawing step. Drawing, that is elongating the filament, generally results in at least partial orientation of the polymer molecules and in better mechanical properties of the fibre. Drawing can be performed on a fibre in a liquid state, that is on a molten filament or on a solution filament as it leaves a spinneret hole, on a semi-solid or gel-like filament or on a solid filament after cooling and at least partial removal of solvent. Preferably, drawing is performed in more than one step, e.g. on filaments in liquid, gel and/or solid state, and/or at different temperatures.

The process for making a polyethylene yarn according to the invention further comprises the step e) of applying a spin finish at least once in an amount of 0.1-10 mass % based on the filament, to a filament that contains less than 50 mass % of the solvent; the spin finish comprising at least 95 mass % of at least one volatile compound having a boiling point at 0.1 MPa pressure of from 30 to 250° C.

The spin finish can be applied by any known method, for example by passing through a bath, by using a nozzle, a wick, a rotating wheel or nip roll, or by spraying. In the process according to the invention the spin finish is applied in an amount of 0.1-10 mass % based on the filament. The applied amount depends on the requirements with regards to e.g. the amount of lubrication needed. A higher amount generally results in less friction and less static charging, and thus in easier processing. If the amount applied is too high, excess finish may drop off or collect on the equipment, which may cause undesired effects, like fouling or pollution, collection of dust or other particles, or excess slip. Preferably, the applied amount is therefore about 0.2-5 mass %, more preferably 0.3-4, 0.4-3, or even 0.5-2.5 mass %. Relatively high amounts of said spin finish may be applied compared with conventional finishes, without causing problems later on in the process or subsequent handling. The optimum amount also depends on the diameter of the filaments and volatility of the compound.

The place at which the spin finish is applied in the process according to the invention depends on the specific processing steps, but should be at a stage where the filament contains less than 50 mass % of the solvent, in order to prevent interference with solvent removal. Preferably, the spin finish is applied to a filament containing less than 40, less than 30, 20 or even less 10 mass % of solvent. Most preferably, the spin finish is applied at least on the fibre before a last drawing step, when the filament contains less than 5 mass % of solvent, to allow easy transport of the filaments over rolls and the like. Drawing is generally performed at elevated temperatures, and the spin finish may at least partly be removed during such operation. Depending on subsequent steps in the process, a certain amount of spin finish may be applied again. It is a distinct advantage of the process according to the invention that the spin finish can be applied as often as is needed, and still be easily and virtually completely removed.

The spin finish that is applied in the process according to the invention comprises at least one volatile compound having a boiling point at 0.1 MPa pressure of from about 30 to 250° C. The volatile compound can be a non-solvent or a solvent for a polyolefin, or a mixture thereof. Examples of suitable solvents for polyolefin include aliphatic or aromatic hydrocarbons, like decalin. The volatile compound is preferably a non-solvent for polyolefin, meaning that it is generally a relatively polar compound. This has the advantage that the compound remains on the surface and hardly diffuses into the polyolefin, does not affect the drawing behaviour of the filaments, and can more easily be removed via evaporation, by a gas flow, or with an air jet or air knife. In addition, polar compounds are more effective in controlling inter-filament cohesion and reducing static electricity. Suitable volatile compounds include polar organic compounds, like compounds that contain in addition to C and H atoms also at least one hetero atom like O, N, P, F, Cl etc. Examples of suitable compounds include alcohols, aldehydes, ketones, esters, ethers, and also water, and mixtures thereof. Preferably, the spin finish comprises at least one alcohol and/or ketone and water. Such a mixture, which may be homogeneous or in the form of a dispersion, combines effective functioning and easy removal. Good results have been obtained with mixtures of ethanol, butanol, or isopropanol and water. In a preferred embodiment, the spin finish is an ethanol/water, optionally azeotropic, or an isopropanol/water mixture. In another embodiment a dispersion of methyl iso-butylketon in water is chosen. In a further special embodiment, the spin finish substantially comprises water. This constitutes a simple yet highly surprising embodiment, since known spin finishes generally apply water as a solvent or dispersion medium, yet effective functioning of water as such was not recognized so far, maybe because it is common practice to directly evaporate it after applying the spin finish. In another preferred embodiment of the invention, the at least one volatile compound in the spin finish is a mixture of a non-solvent and a solvent for polyolefin. Generally such a mixture is not miscible. Preferably, such a mixture is a dispersion of a solvent for polyolefin in a non-solvent for polyolefin that is physically stabilized by for example turbulence stabilisation; and thus without using chemical stabilizers like surfactants, which might otherwise result in increased residue levels. A suitable example includes a dispersion of a up to 10 mass % of decaline in water. Applying such a mixture as spin finish has the advantage that inter-filament cohesion and adhesion to other substrates during later processing steps, e.g. during making of semi-finished articles, can be better controlled.

The boiling point at atmospheric pressure of the volatile compounds in the spin finish should be above room temperature to prevent premature evaporation, but below about 250° C. to allow complete evaporation within a certain time. Depending on the processing temperatures, the desired time of functioning, that is the time that the spin finish should remain on the filament surface, and the desired ease of removal, the boiling point is preferably from about 40 to 200; from 50 to 180; from 60 to 160: from 70 to 150; more preferably from 75 to 145° C.

In order to remove the spin finish by evaporation, the filament is exposed, after applying the spin finish, to a temperature of below the melting temperature of the filament, e.g. with a heated gas flow. The temperature should remain below the melting temperature to prevent relaxation or even melting of the filament. Since a higher temperature will ease evaporation the temperature is preferably up to about 25° C., more preferably 20, 10, 5 or even 2° C. below the melting temperature of the polyethylene filament. Within the context of this application the melting temperature of the filament is understood to be the peak melting temperature as observed in a DSC-scan on a sample of the filament under the conditions as in the process. The filament is preferably exposed to temperatures close to, e.g. 5 or 2° C. below the melting point while keeping the filament or yarn under strain or under an elongational force, because mechanical properties are than better retained. Even more preferably, removing the spin finish coincides with a drawing step. In such case the spin finish performs its function during the drawing step, and is virtually completely removed at the end of such step. If subsequent processing would require the presence of or benefit from spin finish, it may be applied again without risk of deteriorating mechanical properties.

The conditions, that are e.g. time, pressure, gas flow, and temperature, of exposing the filament to a temperature below the melting point of the filament to result in carbon and oxygen atomic concentrations at the surface of the filament of at least 95% C and at most 5% O, as measured by XPS analysis can be found by routine experimentation. Details on the XPS measurement method are provided under Example 1.

The spin finish that is applied in the process according to the invention comprises at least 95 mass % of at least one volatile compound and at most 5 mass % of other components. Examples of other components are additives that enhance the performance of the spin finish, for example its lubricating or antistatic functioning; components that increase electrical conductivity like salts, or components that act as a bactericide or fungicide; or as an antioxidant. In a special embodiment, the other component comprises a non-volatile solvent for polyolefin. This has the advantage that adhesion of fibres thus made to a matrix material in a composite article can be improved. Of course, such additive components should be approved for use in the targeted application of the fibre. If the spin finish comprises about 5 mass % of other components, the amount of spin finish applied is chosen such that the amount of residues on the fibre remains below the desired level.

Preferably, the spin finish comprises at least 96, 97, 98, 99 or 99.5 mass % of said volatile compounds; even more preferably at least 99.7 mass %. The advantage of such higher content is that the amount of residues is further reduced, also if a relatively high amount of spin finish is applied, or if spin finish is applied several times. It has been found that it is advisable to apply the spin finish in relatively high amounts to the fibre in such cases. In a special embodiment, the spin finish comprises essentially only said at least one volatile compound. It has surprisingly been observed that a spin finish comprising essentially no components commonly considered necessary for providing lubricating and anti-static properties, still enables making of a polyolefin fibre with a stable process.

With the process according to the invention a polyethylene yarn is obtained that is substantially free from residues, i.e. a polyethylene yarn that has a very low or no measurable amount of residues on the surface of the yarn or its filaments. When compared with fibres that were prepared with a conventional spin finish and subsequently subjected to a washing or extraction step, the present yarn shows improved mechanical properties, especially the tensile strength is on the level of conventionally produced fibres, whereas the tensile strength of washed or extracted fibres was found to decrease about 10-20%. In case no spin finish was applied during the process of making polyethylene yarn, production appeared very troublesome. The mechanical properties of yarn material thus obtained, seriously lack behind comparable material made with a conventional spin finish; a lowering in tensile strength of about 20% has been observed.

The invention therefore also relates to a polyethylene yarn obtainable by the process according to the invention having a tensile strength of at least 30 cN/dtex. Such yarn also has carbon and oxygen atomic concentrations at the surface of at least 95% C and at most 5% O, as measured by XPS analysis, whereas preferably S (sulphur) or P (phosphor) cannot be detected with XPS.

Preferably, the polyethylene yarn according to the invention has a tensile strength of at least 32, at least 34 or even at east 36 cN/dtex. The surface of the yarn is substantially free of residues, preferably the atomic concentrations are at least 96% C, or even at least 97, 98, 99% C, and at most 4% O, or even at most 3, 2, 1% O as measured by XPS analysis. The procedures of tensile strength measurement and XPS analysis are further detailed under Example 1. Most conventional spin finishes contain a polyalkylene oxide derivatives, typically polyethylene oxide derivatives (abbreviated as PEO), and Na- and/or K-containing compounds as additives. The polyethylene yarn according to the invention typically contains less than 500 ppm of PEO and less than 20 ppm of potassium (K), as determined with NMR spectroscopy and NM analysis, respectively (refer to Example 1 for details on methods used). Preferably, the polyethylene yarn according to the invention contains less than 250 ppm of PEO and less than 10 ppm of K. Even more preferred PEO levels are less than 200, 100 or 50 ppm. Such low amounts of residues are on the limit of amounts that can be determined with sufficient reproducibility. The advantage of polyethylene yarn having such low amount of residues, or positively formulated polyethylene yarn of such high purity, is that the yarn is eminently suited for use in biomedical and other critical applications.

The invention further relates to a process for converting polyolefin fibres into a semi-finished or end-use product, comprising the steps of a) applying 0.5-10 mass % based on the fibres of a spin finish, which spin finish comprises at least 95 mass % of at least one volatile compound having a boiling point at 0.1 MPa pressure of from 30 to 250° C.;
b) removing the spin finish by exposing the fibres during or after further converting steps to a temperature of below the melting temperature of the fibres.

During further processing of polyolefin fibres and converting them into semi-finished or end-use products the same problems relating to friction, inter-filament cohesion and static charge development generally occur as described above for the process of making polyethylene yarn. Examples of such further processing and converting include post-drawing, plying or twisting, texturizing, heat-setting, braiding, weaving, knitting, rope and cord making, and composites production via e.g. filament winding or unidirectional techniques. The advantage of the present process is that starting from polyolefin fibres that are substantially free from spin finish residues, said problems are overcome, while still producing products that are also substantially free from spin finish residues, without the need of washing or extraction steps. Again, the spin finish may be applied at more than one stage if desired.

In the process for converting polyolefin fibres according to the invention any polyolefin fibre can be applied. A fibre is understood to be a continuous or semi-continuous object such as a monofilament or filament, multi-filament yarn, or a tape. In principle, the filaments may have any cross-sectional shape and thickness. The fibre can have been made by any known spinning process, including melt spinning, as well as solution spinning, such as a gel spinning process. Various polyolefins can be applied in the process according to the invention. Suitable polyolefins include polyethylene and polypropylene homo- and copolymers. The polyolefin may also be a mixture of a polyethylene or polypropylene and small amounts of one or more other polymers, in particular other alkene-1-polymers. Preferably, linear polyethylene (PE) is chosen as polyolefin. Linear polyethylene is herein understood to be polyethylene with less than one side chain or branch having at least 10 carbon atoms per 100 carbon atoms, and preferably less than one side chain per 300 carbon atoms, and which may further contain up to 5 mol % of or more alkenes that can be copolymerized with it, such as propylene, butene, pentene, 4-methylpentene or octene. The polyolefin may further contain small amounts of additives that are customary for such fibres, such as antioxidants, thermal stabilizers, colorants, etc. More preferably, the polyolefin fibre is a gel-spun UHMwPE fibre, because of its high strength and modulus.

In order to remove the spin finish again, the product is exposed to a generally higher temperature, but well, e.g. about 20° C., below the melting point of the polyolefin fibre, in order to prevent any deterioration of the properties of the fibrous material. The temperature may be increased to about 10, 5 or even 2° C. below the melting temperature of the polyolefin fibre, e.g. during a post-stretching or heat-setting step, but than the fibre is preferably kept under strain. Further preferred embodiments of the process according to the invention are similar to those described for the process of making polyethylene yarn above.

The invention also relates to a semi-finished or end-use product obtainable by the process for converting polyolefin fibres according to the invention. More specifically, the invention relates to products obtainable by the process according to the invention, which products have carbon and oxygen atomic concentrations at the surface of at least 95% C and at most 5% O as measured by XPS analysis. The surface of the fibres in such product is substantially free of residues, preferably the atomic concentrations are at least 96% C, or even at least 97, 98, 99% C, and at most 4% O, or even at most 3, 2, 1% O as measured by XPS analysis. The procedure of XPS analysis is further detailed under Example 1. Most conventional spin finishes contain a polyalkylene oxide derivatives, typically polyethylene oxide derivatives (abbreviated as PEO), and Na- and/or K-containing compounds as additives. The polyethylene yarn according to the invention typically contains less than 500 ppm of PEO and less than 20 ppm of potassium (K), as determined with NMR spectroscopy and NAA analysis, respectively (refer to Example 1 for details on methods). Preferably, the product according to the invention contains less than 250 ppm of PEO and less than 10 ppm of K on the surface of fibres therein. Even more preferred PEO levels are less than 200, 100 or 50 ppm, which last level is below the detection limit. Preferably, such products further show no detectable S or P amount as measured by XPS analysis. The advantage of products containing polyolefin fibres having such low amount of residues is that they are eminently suited for use in biomedical and other critical applications.

For that reason, the invention also concerns use of the polyethylene yarn according to the invention, or the semi-finished or end-use product according to the invention in biomedical applications.

The invention further relates to a biomedical product comprising the polyethylene yarn according to the invention, or the semi-finished or end-use product according to the invention.

Finally, the invention also concerns use of a composition comprising at least 95 mass % of at least one volatile compound having a boiling point at 0.1 MPa pressure of from 30 to 250° C. as a spin finish in a process for making a polyethylene yarn or for converting polyolefin fibre into a semi-finished or end-use product. Preferred embodiments of this composition are similar to the spin finish compositions described in the processes according to the invention above.

The invention will now be further elucidated with the following examples and comparative experiments.

EXAMPLE I

An UHMwPE yarn was made via a gel spinning process. A solution of 2 mass % of UHMwPE of IV 18 dl/g in decaline was spun at about 130° C. through a spinneret into filaments, by cooling with a nitrogen gas flow and simultaneously evaporating about 50% of the decaline, while applying a force to draw the filaments. A mixture of ethanol/butanol/water of volume ratio 40/5/55 was applied to the gel filaments in an amount of about 2% based on filament. The filaments were subsequently further drawn in two steps; first at about 125-130° C. during about 2 minutes with a draw ratio of about 4.5; than at about 150° C. during about 2 minutes applying a draw ratio of about 6; during which steps both remaining spinning solvent and applied spin finish was removed. Processing ran without interruptions at steady rate.

Properties of the fibre obtained were determined as follows:

Tensile strength (or strength), tensile modulus (or modulus) and elongation at break are defined and determined on multifilament yarns as specified in ASTM D885M, using a nominal gauge length of the fibre of 500 mm, a crosshead speed of 50%/min and Instron 2714 clamps. On the basis of the measured stress-strain curve the modulus is determined as the gradient between 0.3 and 1% strain. For calculation of the modulus and strength, the tensile forces measured are divided by the titre, as determined by weighing 10 metres of fibre;

The amount of polyethylene oxide derivatives (PEO) was measured with $^{1}$H-NMR spectroscopy using a Bruker DRX-500 apparatus, on a solution of about 8 mg sample in deuterated 1,1',2,2'-tetrachloroethane, containing 2 mg DBPC in 20 mL solvent, at 135° C. The indicated amount is calculated as the relative area of the signal attributed to PEO at 3.57 ppm. Detection limit for PEO was estimated to be about 50 ppm.

Atomic concentrations at the surface of the fibres, especially carbon and oxygen, were measured by XPS analysis. The measurements were carried out with Phi Quantum 2000 equipment. Samples were prepared by wrapping the filament around a metal sample holder. In each analysis a number of filaments (defined by the analysis area) were measured. Each sample was measured on two positions. During the measurements the angle between the axis of the analyser and the sample surface was 45°; the information depth is then about 5 nm. Monochromatic AlKα radiation was used, with a measuring spot of 100 μm; the measured area was 800×400 μm. By means of wide scan measurements the elements present at the surface have been identified. The chemical state and concentration of the elements was determined by means of narrow scan measurements. Standard sensitivity factors were used to convert peak areas to atomic concentrations. Presence of PEO derivatives was apparent from a signal attributed to C—O in addition to aliphatic C—C signal, in correspondence with increased O signal.

Sodium and potassium concentrations were quantitatively determined with Neutron Activation Analysis (NAA), which technique provides absolute results independent of sample geometry. A fibrous sample was placed without further preparation steps in channel S84 of the BR-1 nuclear reactor in Mol (Belgium) and radiated with neutrons. Short-living radionuclides were analysed with gamma-spectroscopy according to the so-called $K_0$-method.

The results of these tests are summarized in Table 1.

EXAMPLE II

Analogous to Example I an UHMwPE fibre was made via a gel spinning process, be it that a composition of isopropanol/water (25/75) was applied as spin finish in an amount of about 2.5 mass %. Processing ran smoothly without breaking of filaments. In Table 1 results of tensile measurement and analyses are summarized.

EXAMPLE III

Analogous to Example I an UHMwPE fibre was made via a gel spinning process, be it that water containing about 1 mass % of decaline dispersed into fine particles was applied to the filaments in an amount of about 2 mass %. Production of high strength yarn ran continuously and with steady processing, at a final uptake rate of about 7% lower as compared with a situation in which a conventional spin finish was applied. In Table 1 results of tensile measurement and analyses are summarized.

Comparative Experiment A

UHMwPE fibre was made via a gel spinning process analogously to above examples, but a conventional spin finish was applied in an amount of about 2 mass %. The exact composition of spin finishes is generally proprietary knowledge; the generalized composition of the applied finish was: 28.6 mass % of polyethylene oxide derivatives, 3.25 mass % of Na- and K-containing compounds, 0.05 mass % of a perfume oil, 1 mass % of ethylene glycol, with water as solvent. After evaporation of water, about 0.7 mass % of components remains on the fibre surface. In Table 1 results of tensile measurement and analyses are summarized.

Comparative Experiment B

In this experiment it was tried to make UHMwPE fibre via the same gel spinning process as described for other experiment, but without applying any spin finish. During drawing of the filaments breakage occurred several times. Nevertheless, some representative simple material could be made, but at relatively low spinning/drawing speed (about 60% of Exp. 1). Tensile properties are found to be significantly lower than for other fibres, see Table 1.

TABLE 1

| | Tensile properties | | | Analyses of residues | | | | | | | | |
|---|---|---|---|---|---|---|---|---|---|---|---|---|
| | Strength (cN/dtex) | Modulus (cN/dtex) | Elongation at break (%) | PEO (ppm) | C (at %) | O (at %) | N (at %) | Si (at %) | P (at %) | S (at %) | Na (ppm) | K (ppm) |
| Example 1 | 34.2 | 1200 | 3.5 | nd | 98.5 | 1.0 | 0.4 | 0 | 0 | 0 | 4.3 | 2.0 |
| Example 2 | 34.1 | 1180 | 3.5 | nd | 98.0 | 1.2 | 0.8 | 0 | 0 | 0 | 4.4 | 2.0 |
| Example 3 | 34.3 | 1190 | 3.4 | nd | 97.6 | 1.8 | 0.6 | 0 | 0 | 0 | 4.3 | 2.0 |
| Comp. Exp. A | 35.1 | 1200 | 3.5 | 1290 | 80.4 | 18.2 | 0.3 | 0.8 | 0.2 | 0.1 | 17.7 | 20.5 |

TABLE 1-continued

| | Tensile properties | | | Analyses of residues | | | | | | | | |
|---|---|---|---|---|---|---|---|---|---|---|---|---|
| | Strength (cN/dtex) | Modulus (cN/dtex) | Elongation at break (%) | PEO (ppm) | C (at %) | O (at %) | N (at %) | Si (at %) | P (at %) | S (at %) | Na (ppm) | K (ppm) |
| Comp. Exp. B | 28.0 | 1150 | 3.0 | nd | 97.9 | 1.4 | 0.7 | 0 | 0 | 0 | 4.3 | 2.0 |
| Comp. Exp. C1 | 36.6 | 910 | 4.1 | 1700 | — | — | — | — | — | — | 31 | 33 |
| Comp. Exp. C2 | 33.2 | 940 | 3.6 | 250 | 98.1 | 1.6 | 0.0 | 0 | 0.3 | 0 | 27 | 29 |

nd = not detected;
— = not measured

Comparative Experiment C

A commercial UHMwPE fibre sample, Dyneema® SK75, a two-ply yarn of 2*440 dtex available from DSM high Performance Fibers BV (NL), that was produced in a gel-spinning process with application of a conventional spin finish was subjected to an extraction procedure to remove spin finish components from the fibre. Yarn was loosely wound around a cylindrical, perforated polypropylene core, and subjected to Sohxlet-extraction with chloroform during 3 hours. After standing in chloroform for 18 hours, the sample was again Sohxlet-extracted with chloroform during 7 hours, after which this last cycle was repeated. Subsequently, the sample was dried in an oven at 40° C. under reduced pressure until a constant mass was reached after 7 days. Before (C1) and after (C2) extraction tensile properties were measured, and residue concentration on the surface was determined. The results presented in Table 1 indicate that about 85% of PEO-type of compounds was removed, but that N- and K-containing compounds substantially remained on the fibres. Moreover, tensile properties dropped about 10-14% upon extraction.

Comparative Experiment D

A commercial UHMwPE fibre sample, Dyneema® SK65, a 220 dtex yarn available from DSM high Performance Fibers BV (NL), that was produced in a gel-spinning process with application of a conventional spin finish was subjected to a washing step with several aqueous detergent solutions, that further contained 1 g/dm$^3$ of soda. The used detergents are commercially available from Zschimmer&Schwarz GmbH, Lahnstein, Germany. The yarn was loosely wrapped around a glass rod and submersed in a stirred detergent solution at 80° C. during 15 minutes. Subsequently, the yarn was flushed with hot water (70° C.) and cold water. The effect of washing was measured by determining the content of PEO-containing compounds with NMR and Na- and K-content with NAA (see Example I for details).

The results summarized in Table 2 indicate that none of the washing solutions was able to remove substantially all of the finish residues from the yarn.

TABLE 2

| | Type of detergent (aqueous soda; 1 g/dm$^3$) | PEO content (ppm) | Na content (ppm) | K content (ppm) |
|---|---|---|---|---|
| Comp. Exp. D1 | No washing | 4000 | 34 | 46 |
| Comp. Exp. D2 | Depicol ND; 3 g/dm$^3$ | 700 | 13.2 | 4.5 |
| Comp. Exp. D3 | Depicol TLK; 2 g/dm$^3$ | 1000 | 4.2 | 2.4 |
| Comp. Exp. D4 | Tissocyl RLB; 2 g/dm$^3$ | 600 | 16.5 | 5.4 |
| Comp. Exp. D5 | Tissocyl NEC; 3 g/dm$^3$ | 700 | 5.8 | 2.6 |
| Comp. Exp. D6 | VP 111; 2 g/dm$^3$ | 700 | 7.7 | 4.4 |

The invention claimed is:

1. Process for making a polyethylene multi-filament yarn comprising the steps of a) spinning at least one filament from a solution of ultra high molecular weight polyethylene in a solvent;

b) cooling the filament obtained to form a gel filament;

c) removing at least partly the solvent from the gel filament;

d) drawing the filament in at least one drawing step before, during or after removing solvent;

e) applying a spin finish at least once in an amount of 0.1-10 mass % based on the filament, to a filament that contains less than 50 mass % of the solvent; the spin finish comprising at least 95 mass % of at least one volatile compound having a boiling point at 0.1 MPa pressure of from 30 to 25000; and f) removing the spin finish by subsequently exposing the filament to a temperature of below the melting temperature of the filament, such that carbon and oxygen atomic concentrations at the surface of the filament of at least 95% C and at most 5% O, as measured by XPS analysis, result.

2. Process according to claim 1, wherein the spin finish comprises a volatile compound that contains in addition to C and H also at least one O atom, or water.

3. Process according to claim 1, wherein the spin finish is applied to a filament containing less than 10 mass % of the solvent.

4. Process according to claim 1 wherein the spin finish is applied in an amount of about 0.2-5 mass %.

5. Process according to claim 1, wherein the spin finish comprises at least one alcohol and/or ketone and water.

6. Process according to claim 1, wherein the spin finish comprises at least 99 mass % of at least one volatile compound.

7. Process according to claim 1, wherein the volatile compound has a boiling point from 50 to 180° C.

8. Process according to claim 1, wherein the spin finish substantially comprises water.

9. Process according to claim 1, wherein the spin finish is removed by exposing the filament to a temperature of up to about 5° C. below the melting temperature of the filament.

10. Process according to claim 1, wherein removing the spin finish coincides with a drawing step.

11. Polyethylene multi-filament yam made by the process according to claim 2, which yam is substantially free from spin finish residues, containing less than 500 ppm polyalkylene oxide derivatives and less than 20 ppm of potassium as determined with NMR spectroscopy and NM analysis, respectively, and which yarn has a tensile strength of at least 30 cN/dtex.

12. Process for converting polyolefin fibres that are substantially free from spin finish residues into a semi-finished or end-use product, comprising the steps of a) applying 0.5-10 mass % based on the fibres of a spin finish, which spin finish comprises at least 95 mass % of at least one volatile compound having a boiling point at 0.1 MPa pressure of from 30 to 250° C.; and b) removing the spin finish by exposing the fibres during or after further converting steps to a temperature of below the melting temperature of the fibres, such that carbon and oxygen atomic concentrations at the surface of the fibres of at least 95% C and at most 5% O, as measured by XPS analysis, result.

13. Process according to claim 12, wherein the spin finish comprises a volatile compound that contains in addition to C and H also at least one O $atom_1$ or water.

14. Process according to claim 12, wherein the polyolefin fibres are gel-spun UHMwPE fibres.

15. Semi-finished or end-use product made by the process according to claim 13, having carbon and oxygen atomic concentrations at the surface of at least 95% C and at most 5% O, as measured by XPS analysis, and containing less than 500 ppm polyalkylene oxide derivatives and less than 20 ppm of potassium as determined with NMR spectroscopy and NM analysis, respectively.

16. A method comprising incorporating the polyethylene yarn according to claim 11 in a biomedical product.

17. Biomedical product comprising the polyethylene yarn according to claim 11.

18. A method comprising incorporating the semi-finished or end-use product according to claim 15 in a biomedical product.

19. Biomedical product comprising the semi-finished or end-use product according to claim 15.

* * * * *

UNITED STATES PATENT AND TRADEMARK OFFICE

CERTIFICATE OF CORRECTION

PATENT NO. : 7,364,678 B2
APPLICATION NO. : 10/537899
DATED : April 29, 2008
INVENTOR(S) : Smit et al.

It is certified that error appears in the above-identified patent and that said Letters Patent is hereby corrected as shown below:

Column 12, line 31, replace "25000" with --250°C--.

Signed and Sealed this

Twenty-first Day of December, 2010

David J. Kappos

David J. Kappos
*Director of the United States Patent and Trademark Office*